US008511673B2

(12) United States Patent
Pillard

(10) Patent No.: US 8,511,673 B2
(45) Date of Patent: Aug. 20, 2013

(54) MAILPIECE SELECTOR DEVICE HAVING MULTIPLE PIVOTALLY-MOUNTED FINGERS

(75) Inventor: Romain Pillard, Avon (FR)

(73) Assignee: Neopost Technologies, Bagneux (FR)

( * ) Notice: Subject to any disclaimer, the term of this patent is extended or adjusted under 35 U.S.C. 154(b) by 476 days.

(21) Appl. No.: 12/913,278

(22) Filed: Oct. 27, 2010

(65) Prior Publication Data

US 2011/0123307 A1 May 26, 2011

(30) Foreign Application Priority Data

Oct. 28, 2009 (FR) ..... 09 57575

(51) Int. Cl.
*B65H 3/52* (2006.01)

(52) U.S. Cl.
USPC ..... 271/121; 271/124; 271/138

(58) Field of Classification Search
USPC ..... 271/121, 124, 3.05, 35, 165, 137, 271/138
See application file for complete search history.

(56) References Cited

U.S. PATENT DOCUMENTS 5,946,996 A 9/1999 Oussani, Jr. et al.
2002/0140162 A1 10/2002 Gasser et al.

OTHER PUBLICATIONS

Search Report for FR 0957575 dated Jun. 4, 2010.

*Primary Examiner* — Michael McCullough
(74) *Attorney, Agent, or Firm* — Sughrue Mion, PLLC

(57) ABSTRACT

A mailpiece selector device comprising a guide co-operating with at least one opposing selector roller to separate mailpieces one-by-one from a stack of mailpieces and to transport them downstream, said guide having at least two adjacent selector fingers having different lengths, it being possible for each of said selector fingers to pivot independently from the other(s) about a common pivot axis and against respective associated resilient return means.

9 Claims, 2 Drawing Sheets

MAILPIECE SELECTOR DEVICE HAVING MULTIPLE PIVOTALLY-MOUNTED FINGERS

FIELD OF THE INVENTION

The present invention relates to the field of mail handling and it relates more particularly to a mailpiece selector device implemented in an automatic feed module or "feeder" of a franking machine or "postage meter" for franking mailpieces.

PRIOR ART

Conventionally, a franking machine needs to be adapted to receive various types of mailpiece, such as documents, letters, or envelopes of greater or lesser thickness, typically lying in the range 0.1 millimeters (mm) to 20 mm. To this end, on the upstream side, such a franking machine often includes an automatic feed module making it possible, in particular, to convey such mailpieces at various speeds. That automatic feed module usually includes means for receiving/stacking, selecting, transporting, and possibly closing such mailpieces.

In particular, the selector means for selecting such mailpieces conventionally comprise a stationary inclined guide co-operating with opposing selector rollers to select the mailpieces one-by-one, and to transport them downstream. Those selector means must be capable of avoiding "double feeds" i.e. of preventing two or more mailpieces from being fed through together, so as to avoid some mailpieces being franked with erroneously-computed postage amounts, and other mailpieces not being franked. In U.S. Pat. No. 5,431,385, the guide is replaced with an inclined belt that, by moving in rotation, drives the mailpieces towards the selector rollers.

Those systems are generally satisfactory when the stack of mailpieces is uniform, i.e. with mailpieces of the same size and thickness, or placed from the thickest to the thinnest so that the thickest is at the bottom of the stack. Conversely, when the stack is not uniform and when, for example, a thick mailpiece overlies (succeeds) a mailpiece of smaller thickness, then it is the mailpiece of larger thickness that is the first one to come into engagement with the guide and not the thinner mailpiece, thereby frequently giving rise to a double feed.

OBJECT AND DEFINITION OF THE INVENTION

An object of the present invention is to mitigate the drawbacks resulting from double feeds of envelopes by proposing a mailpiece selector device for a feeder of a franking machine that can prevent such double feeds from occurring.

This object is achieved by a mailpiece selector device comprising a guide co-operating with at least one opposing selector roller to separate mailpieces one-by-one from a stack of mailpieces and to transport them downstream, wherein said guide has at least two adjacent selector fingers having different lengths, and each of said selector fingers pivots independently from the other(s) about a common pivot axis and against respective associated resilient return means.

Thus, when a thick mailpiece is overlying a thinner mailpiece, the variation in the length of the selector fingers makes it possible to delay the arrival of the thicker mailpiece relative to the arrival of the thinner mailpiece and thus to avoid any double feed.

Preferably, in an initial rest position, said adjacent selector fingers having different lengths also have different angles of inclination relative to the vertical, the longer said length the larger said angle of inclination, or indeed, said adjacent selector fingers having different lengths have different return forces, the shorter said length the larger said return force.

Advantageously, said guide has at least two adjacent series of adjacent selector fingers so that said mailpiece is put into contact with at least two same-length selector fingers of respective ones of said at least two series.

For each of said at least two series, said adjacent selector fingers having different lengths also have different angles of inclination relative to the vertical, the longer the length of the finger the larger said angle of inclination, or indeed said adjacent selector fingers having different lengths have different return forces, the shorter said length the larger said return force.

Advantageously, the closer a selector finger is to a referencing surface for said mailpieces the larger the length of said selector finger.

Preferably, the selector finger having the shortest length has an angle of inclination relative to the vertical that is equal to zero.

The invention also provides a mailpiece feeder for a franking machine, which feeder includes a mailpiece selector device as mentioned above.

BRIEF DESCRIPTION OF THE DRAWINGS

Other characteristics and advantages of the present invention appear more clearly from the following description given by way of non-limiting indication and with reference to the accompanying drawings, in which.

DETAILED DESCRIPTION OF A PREFERRED EMBODIMENT OF THE INVENTION

Figure 1:
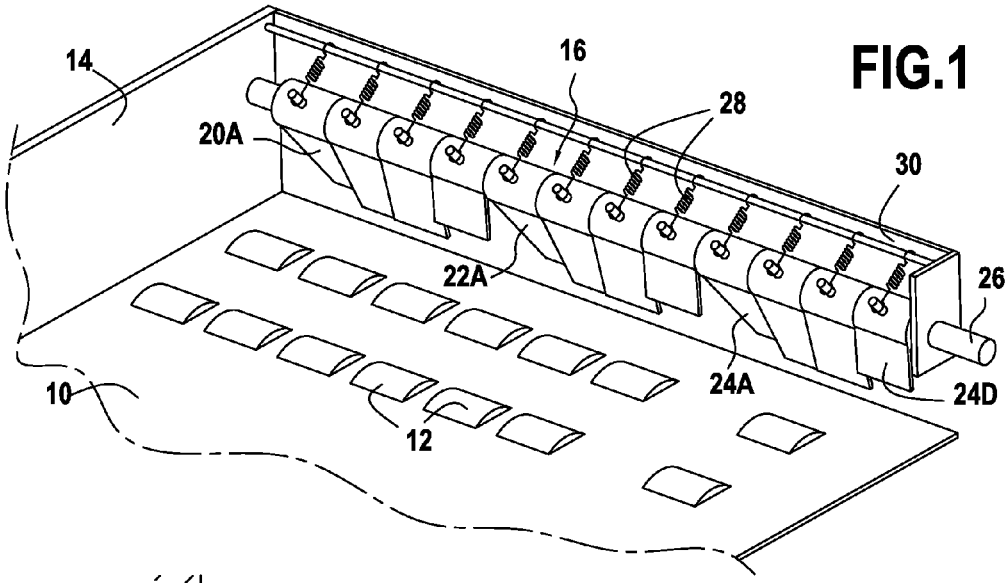
FIG. 1 is a perspective view of a preferred embodiment of the mailpiece selector device of the invention.
Figure 2A:
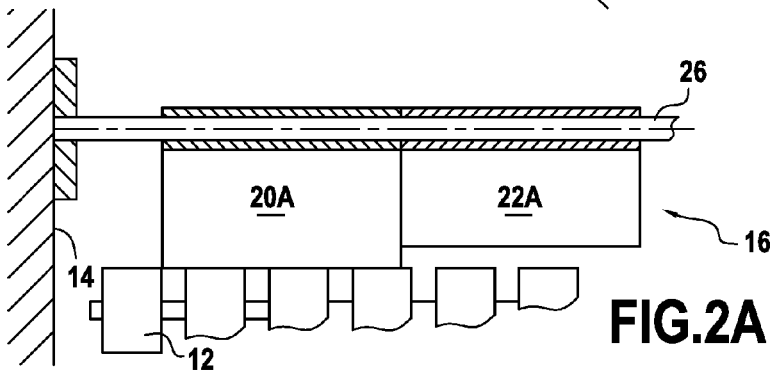
FIG. 2A is a fragmentary cutaway view showing a minimalistic variant of the selector device of the invention.
Figure 2:
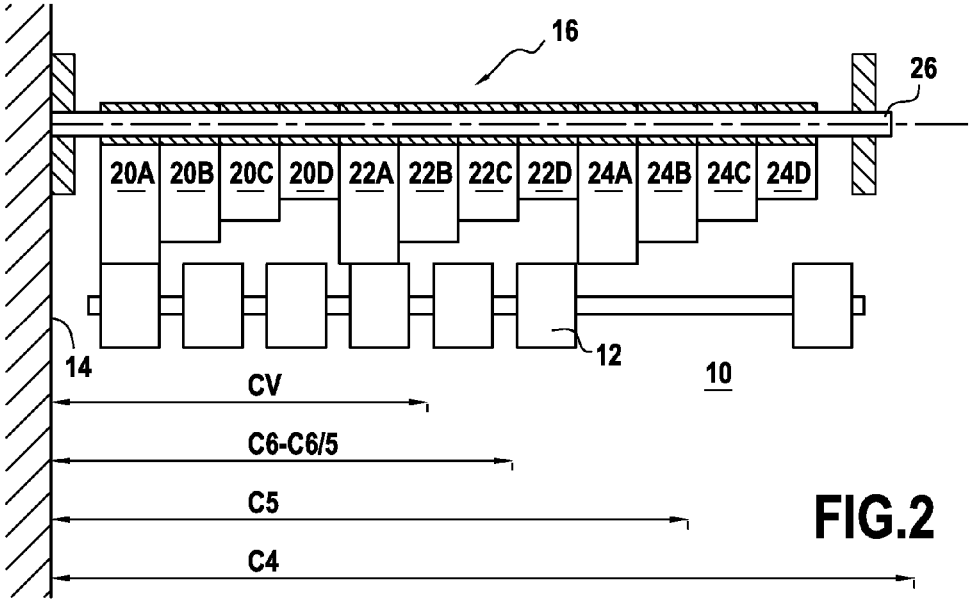
FIG. 2 is a plan view of the preferred selector device of FIG. 1.

As shown in FIGS. 1 and 2, an automatic mailpiece feed module conventionally has a feed zone formed essentially by a deck 10 designed to receive a stack of mailpieces and including first transport rollers 12 for driving the mailpieces downstream (and against a referencing wall 14) at a separation zone having a separator device 16 in which the mailpieces are extracted one by one from the stack of mailpieces. Second transport rollers (referenced 18 in FIGS. 3 and 4) are, in general, provided at the outlet of said separation zone for the purpose of conveying the mailpieces extracted in this way downstream.

In accordance with the invention, the mailpiece selector device is not constituted conventionally by a stationary inclined guide (a comb with stationary teeth) or by an inclined belt, as described in the patent cited in the introduction above, co-operating with a plurality of opposing selector rollers for selecting a single mailpiece only and for transporting it downstream, but rather, it is constituted by a guide that can be said to be "movable" or "dynamic" in the sense that it has a plurality of selector fingers 20A-20D, 22A-22D, 24A-24D, each of which is hinged independently about a common pivot axis 26, and can, as the mailpieces pass over the selector rollers, pivot against resilient return means, e.g. a traction spring 28 having one end secured to the selector finger and the other end in abutment against a framework portion 30 of the selector device. It should be noted that although reference is made to a traction spring, by way of example, naturally a torsion or compression spring may also be suitable, subject to the spring being fastened to the framework in a different fastening configuration, or indeed any other analogous return means may be suitable.

Each selector finger 20A-20D may be made of an elastomer material having a very high coefficient of friction so as to procure the best possible contact with the mailpiece, or indeed may be made of a ceramic material that offers the advantage, compared with elastomer, of not wearing and of not leaving marks on the mailpieces. Each selector finger 20A-24D has a different length depending on its position relative to the referencing wall 14. The inclination may also be different and increase proportionally to length so that the selector finger that is vertical (i.e. the finger having an inclination equal to zero) is the shortest, and the selector finger that has the largest inclination is the longest. In an alternative embodiment (not shown), the inclination may be identical but the return force of the springs 48 is then different, the shortest finger being subjected to the largest force, and the longest finger being subjected to the smallest force.

Thus, the selector finger 20A that is closest to said referencing wall is the finger that is longest (it extends tangentially to the selector rollers) and optionally that has the largest inclination (about 60° relative to the vertical). The finger 20B that is adjacent to it has a shorter length and optionally a smaller inclination, typically a length that is 20% shorter, and an inclination of about 45° relative to the vertical. Similarly, the finger 20C adjacent to the finger 20B has an even shorter length and optionally an even smaller inclination, typically a length that is 40% shorter than the length of the longest finger, and an inclination of about 30° relative to the vertical. Finally, the finger 20D that is of shortest length and that is adjacent to the finger 20C has an even shorter length and an even smaller inclination, typically a length that is 60% shorter than the finger of longest length, and an absence of inclination (inclination of 0°) relative to the vertical. In the example shown, this first series of four selector fingers is followed by a second series of four other similar fingers 22A, 22B, 22C, 22D, and then a third series of four other identical fingers 24A, 24B, 24C, 24D.

Naturally, this configuration is in no way limiting, and various numbers of series of fingers are possible, e.g. from one to four, and various numbers of fingers per series are possible, e.g. from two to five, the number of fingers per series being identical or non-identical from one series to another. Thus in a minimalistic configuration shown in FIG. 2A, the guide of the invention has only two fingers, of different lengths and optionally of different inclinations (unless the return forces on the two fingers are different). These fingers must be of width sufficient to ensure that the mailpiece is engaged properly, and conventionally of width of about ⅔ of the width of a mailpiece of international format C6. In addition, the longer finger that is also the closer to the referencing wall, must be disposed at a distance from said wall that is sufficient to enable a mailpiece of the business card format to be engaged properly. However, rather than that configuration, a preferred configuration has two series of selector fingers, each of the first and second series having two fingers of different lengths and of different inclinations, thereby forming a set of four selector fingers. In order to avoid skewing the mailpieces, it is preferable for them always to be in contact with at least two selector fingers of the same length and of the same inclination, which always applies with two series of fingers having the same number of fingers. The two longer fingers pivot against their respective springs, while the second fingers are pivoted only by mailpieces of thicknesses beyond a predetermined range of mailpiece thicknesses that is defined by the difference in length and in inclination relative to the longer fingers. Thus, by means of the offset that exists between the short fingers and the long fingers, it is possible, for example, to distinguish between two mailpiece thicknesses so that the two longer fingers being pivoted by a mailpiece having a very small thickness, e.g. lying in the range 0 mm to 0.5 mm, does not raise the short fingers, unlike a mailpiece having a larger thickness of up to the maximum thickness of 20 mm.

Figure 3:
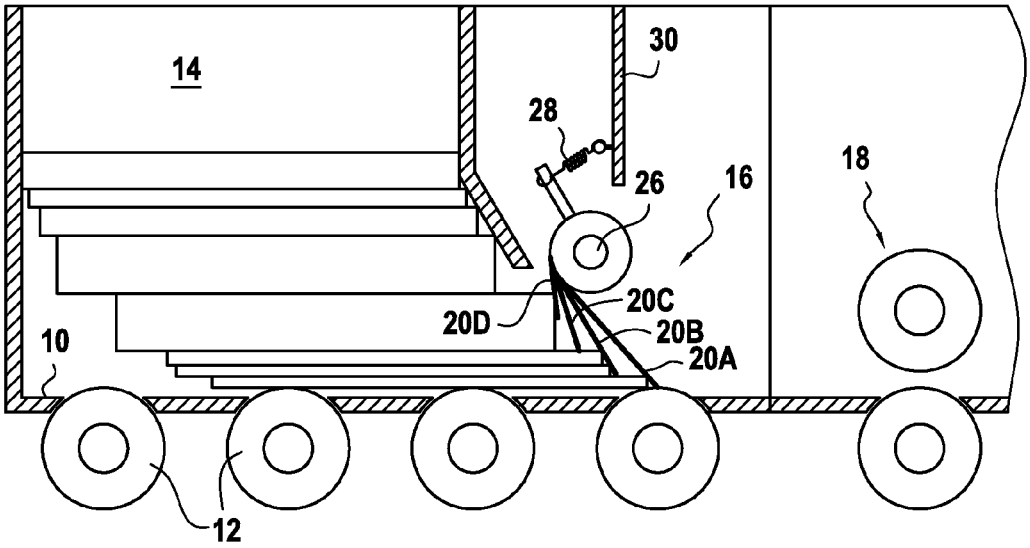
FIGS. 3 and 4 are views showing the preferred selector device of FIG. 1 respectively in an initial rest position and in a subsequent mailpiece selection position in which it selects a mailpiece.
Figure 4:
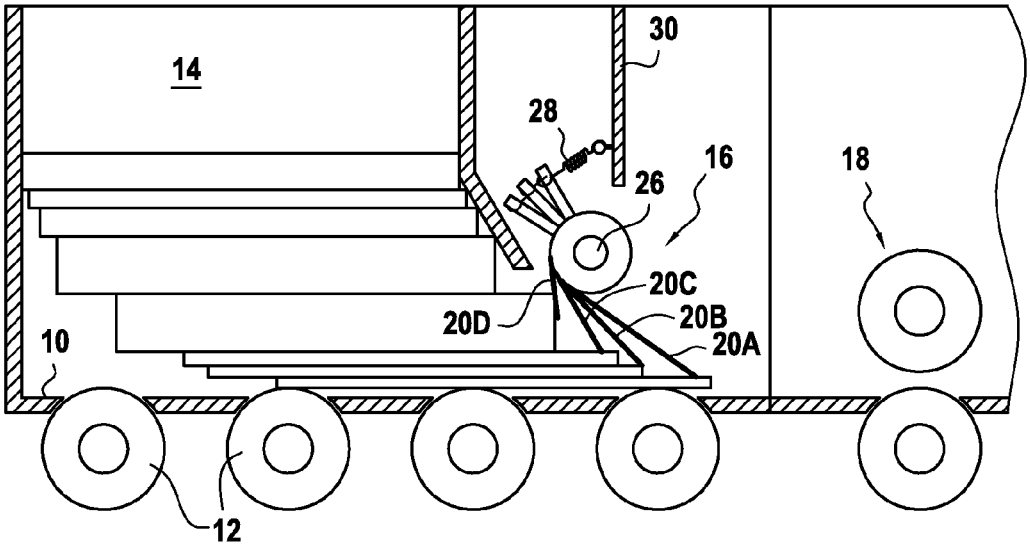

Operation of the selector device of the invention as shown mainly with reference to FIGS. 3 and 4, is as follows. With the mailpieces to be processed being dumped as they come (i.e. as in a stack of mixed mail) on the feed deck 10, for the mailpieces of very small thickness, i.e. of thickness less than 0.5 mm, most of the selection work is done by the longest fingers 20A, 22A (and 24A if the width of the mailpiece so requires), the adjacent fingers 20B, 22B (and also 24B depending on the width of the mailpiece) avoiding, if necessary, any double feeds. For mailpieces of small thickness, i.e. of thickness lying in the range 0.5 mm to 2 mm, the mailpiece raises not only the longest fingers but also the immediately adjacent fingers, the other selector fingers 20C, 22C (and 24C if the width of the mailpiece so requires) avoiding, if necessary, any double feeds. Finally, for mailpieces of standard thickness, typically lying in the range 2 mm to 6 mm, said other selector fingers are also active while the last selector fingers 20D, 22D (and also 24D depending on the width of the mailpiece) are raised only for mailpieces of large thickness, i.e. of thickness greater than 6 mm. In addition, due to the selector finger inclination increasing with increasing selector finger length, a thicker mailpiece overlying a thinner mailpiece cannot, under any circumstances, be selected before or together with said thinner mailpiece, thereby giving rise to a double feed (i.e. to the thin and thick mailpieces passing through together).

This action that differs depending on mailpiece thickness avoids premature wear of the selector fingers that are not concerned that, without this configuration, would be subjected to repeated impacts with all of the mailpieces, and also avoids any creasing of the more fragile mailpieces, such as envelopes having windows.

It should be noted that, as indicated above, and as appears more precisely in the example of FIG. 2, at least the two longest fingers 20A, 22A are activated for mailpieces of the smallest format, i.e. an international format (ISO 216) for business cards CV, whereas at least three fingers 20A, 20B, 20C; 22A, 22B, 22C of each of the first and second series can be activated depending on the thickness of the mailpiece for a mailpiece of international format C6 or C6/5. For a mailpiece of international format C5, at least two fingers 20A, 20B; 22A, 22B; 24A, 24B of each of the first, second, and third series can be activated, and for a mailpiece of international format C4, all of the fingers 20A-24D can be activated depending on the thickness of the mailpiece.

Thus, with the present invention, it is possible for mailpieces of various thicknesses to be processed automatically without selecting any particular operating mode by means of a special lever, as is often necessary in many prior art devices. In addition, the different lengths of the selector fingers make it possible to constrain the mailpieces to be subjected to pressure that varies depending on their thicknesses, because the thicker the mailpiece, the higher the number of the selector fingers with which it comes into contact, so that the stress exerted on it is increasingly large, thereby making it possible to guarantee a selection process that offers good performance.

What is claimed is:

1. A mailpiece selector device comprising a guide co-operating with at least one opposing selector roller to separate mailpieces one-by-one from a stack of mailpieces and to transport them downstream, wherein said guide has at least two adjacent selector fingers having different lengths, and each of said selector fingers pivots independently from the other(s) about a common pivot axis and against respective associated resilient return means.

2. A mailpiece selector device according to claim 1, wherein, in an initial rest position, said adjacent selector fingers having different lengths also have different angles of inclination relative to the vertical, the longer said length the larger said angle of inclination.

3. A mailpiece selector device according to claim 1, wherein said adjacent selector fingers having different lengths have different return forces, the shorter said length the larger said return force.

4. A mailpiece selector device according to claim 1, wherein said guide has at least two adjacent series of adjacent selector fingers so that said mailpiece is put into contact with at least two same-length selector fingers of respective ones of said at least two series.

5. A mailpiece selector device according to claim 4, wherein, for each of said at least two series, said adjacent selector fingers having different lengths also have different angles of inclination relative to the vertical, the longer the length of the finger the larger said angle of inclination.

6. A mailpiece selector device according to claim 5, wherein the selector finger having the shortest length has an angle of inclination relative to the vertical that is equal to zero.

7. A mailpiece selector device according to claim 4, wherein, for each of said at least two series, said adjacent selector fingers having different lengths have different return forces, the shorter said length the larger said return force.

8. A mailpiece selector device according to claim 4, wherein, for each of said at least two series, the closer a selector finger is to a referencing surface for said mailpieces the larger the length of said selector finger.

9. A mailpiece feeder for a franking machine, which feeder includes a mailpiece selector device according to claim 1.

* * * * *